US005123548A

United States Patent [19]

Milne

[11] Patent Number: 5,123,548

[45] Date of Patent: Jun. 23, 1992

[54] HOLDER

[75] Inventor: Alexander P. Milne, North Vancouver, Canada

[73] Assignee: Add-It Systems Incorporated, North Vancouver, Canada

[21] Appl. No.: 720,183

[22] Filed: Jun. 24, 1991

[30] Foreign Application Priority Data

Jun. 26, 1990 [CA] Canada ..... 2019895

[51] Int. Cl.[5] ..... A47F 5/00

[52] U.S. Cl. ..... 211/69.5; 401/88

[58] Field of Search ..... 211/69.5, 69.1; 248/551; 401/52, 88

[56] References Cited

U.S. PATENT DOCUMENTS

| | | | |
|---|---|---|---|
| 1,511,167 | 10/1924 | Jesnig | 211/69.1 |
| 1,889,738 | 11/1932 | Nelson | 401/52 |
| 2,150,065 | 3/1939 | Kahn | 211/69.5 X |
| 4,699,536 | 10/1987 | Berman | 401/88 |
| 4,958,952 | 9/1990 | Willett | 211/69.1 X |

*Primary Examiner*—Robert W. Gibson, Jr.
*Attorney, Agent, or Firm*—Christie, Parker & Hale

[57] ABSTRACT

A writing implement holder to attach to a surface. The holder includes a base to be attached to the surface and having an underside and an opening. There is a recess in the underside surrounding the opening. A cylinder receives the writing implement and is itself located in the opening in the base. A flange at one end of the cylinder is received in the recess in the underside of the base. The upper surface of the cylinder extends inwardly downwardly and is of such a depth that it prevents the writing implement being used to lever the base from the surface. One plug is received in the writing implement and another plug is received in the base and a cable extends between the two plugs. Each end of the cable is secured beneath a plug so that the writing implement is attached to the base. It is desirable that the plug be tightened and loosened by uncoventional means. Accordingly, a tool is also described to engage openings formed in the upper surface of each plug to tighten and loosen the plug. The holder is pleasing in appearance and cannot be removed except with difficulty and, if vandalized, can be economically serviced without removal from the surface.

11 Claims, 2 Drawing Sheets 50
42
30
38
26
28
22
43
24
20
16
12
14
44
18
46
48
23
27
50
32
36
34
10
42
38

52
56
54
58
58

40
50
50
26
30
42
28
22
27
48
12
34
14
24
20
23
44
43
38
40
50
50
32
36
42

38
64
60
62
66
66
32
36
42

HOLDER

FIELD OF THE INVENTION

This invention relates to a writing implement holder able to attach to a surface. Usually the writing implement will be a pen.

DESCRIPTION OF THE PRIOR ART

It is common in financial institutions to provide ball point pens to allow the writing of cheques, deposit slips and the like. The writing implements must be attached to a surface. Otherwise their loss is inevitable.

There are a large numbers of methods of attaching pens in financial institutions. Typically, a cable or chain is used and is secured, for example, by screwing to the surface.

It is also known to use a small receiving cylinder to receive the writing implement, often attached by a pivotal joint to the surface.

The prior art is easily vandalized. The attachment means can easily be broken and the mounting is such that it can easily be removed from the surface to which it is attached. Replacement is expensive and the necessity to replace is bad for public relations.

Thus, from all points of view, it is preferable to have a system that is pleasing in appearance, cannot be removed except with difficulty and, if vandalized, can be easily and economically serviced without removal from the surface.

SUMMARY OF THE INVENTION

The present invention seeks to provide such a system and provides a writing implement holder to attach to a surface and comprising:

- a base to be attached to the surface having an underside and including an opening;
- a recess in the underside, surrounding the opening;
- a cylinder to receive the writing implement located in the opening in the base;
- a flange at one end of the cylinder to be received in the recess in the underside of the base;
- the upper surface of the cylinder extending inwardly, downwardly and being of a depth to prevent the writing implement being used to lever the base from the surface;
- a first plug to be received in the writing implement;
- a second plug to be received in the base;
- a cable extending between the first and second plugs, with each end of the cable secured beneath a plug whereby the writing implement is attach to the base.

Preferably the base is attached by an adhesive on the underside but there may also be an opening in the cylinder to receive a screw to extend into the surface.

The writing implement preferably has an internal thread and the first plug has an external thread to be received in the internal thread of the writing implement. Similarly, the base preferably has a threaded recess with an external thread on the second plug to be received in the threaded recess.

The plugs have means in their upper surfaces to allow screwing and unscrewing into the pen and the base respectively. In a desired aspect the means are unconventional, that is cannot be screwed or unscrewed by a conventional screwdriver or the like. In a preferred embodiment the means comprises spaced openings formed in the upper surface of each plug. The holder is then supplied with a tool comprising a handle with prongs projecting downwardly, the prongs being dimensioned and spaced to engage the openings in the plug.

BRIEF DESCRIPTION OF THE DRAWINGS

Aspects of the invention are illustrated, by way of example, in the drawings, in which.

DESCRIPTION OF THE PREFERRED EMBODIMENT

Figures 1, 1A:
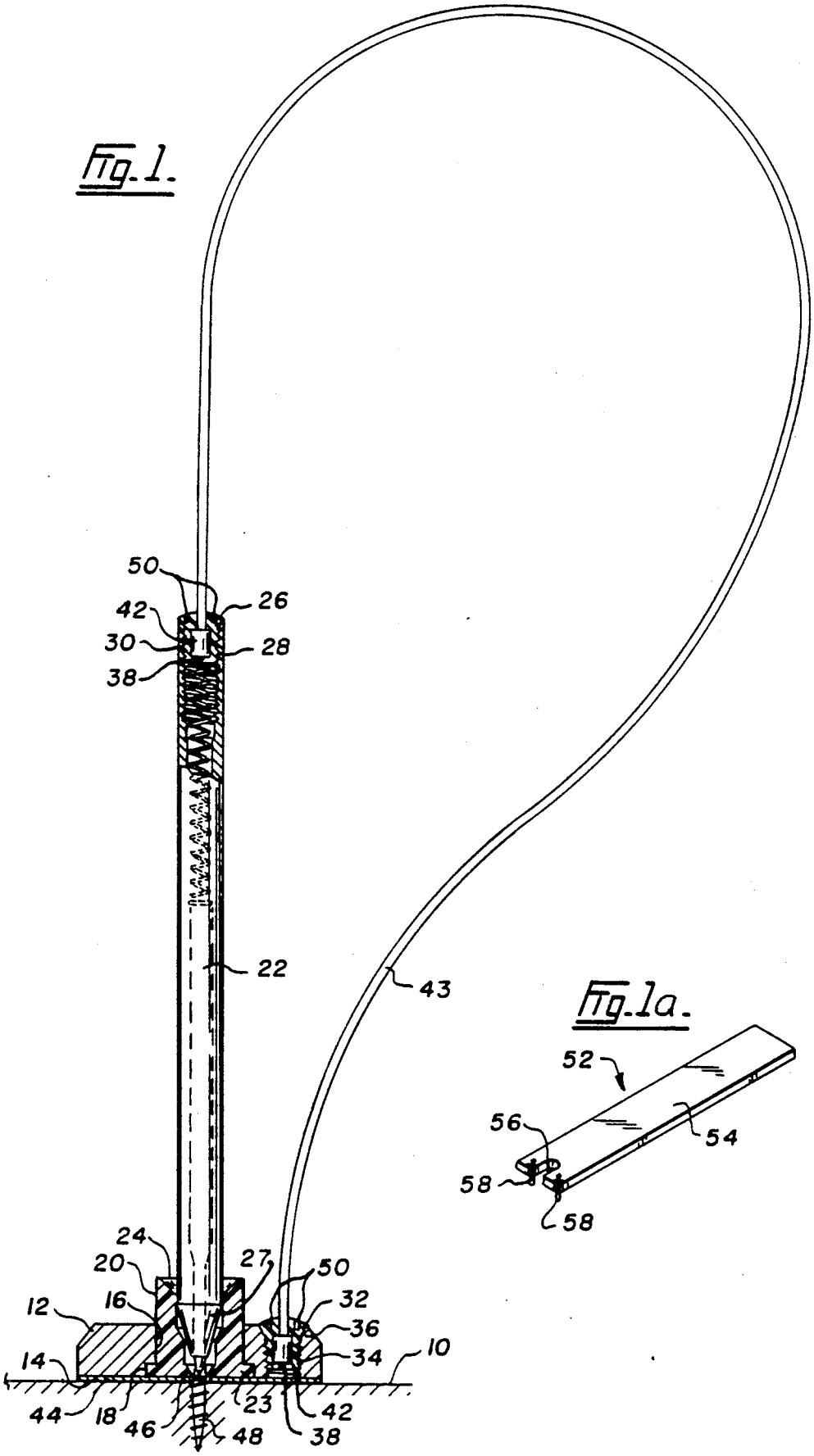
FIG. 1 is a side elevation, partly in section, of the holder according to the present invention.
FIG. 1*a* is a perspective view of a tool useful with the holder of the invention.

The drawings show a writing implement holder to attach to a surface 10 and comprising a base 12 to be attached to the surface 10 having an underside 14 and including an opening 16. There is a recess 18 in the underside 14 surrounding the opening 16. A hollow cylinder 20 receives the writing implement (a pen 22 is shown) and is located in the opening 16 in the base 12. The cylinder 20 has a flange 23 at its lower end to be received in the recess 18. The upper surface 24 of the cylinder 20 extends inwardly, downwardly and the cylinder is of shallow depth to prevent the pen 22 being used to lever the base 12 from the surface 10. For the same reason pen 22 is tapered at its base 27. The arrangement is such that if pressure is applied to the upper end of the pen 22 in a direction parallel to the surface 10 in an attempt to lever the holder from the surface 10, the pen 22 simply slides out of the cylinder 20, assisted by the shallowness of the cylinder, the sloping upper surface of the cylinder and the taper of pen 22.

There is a first plug 26 received in the pen 22. The pen 22 has an internal thread 28 and there is an external thread 30 on the first plug 26 to be received in the internal thread 28 of the pen 22. A second plug 32 is received in the base 12. The base has a threaded recess 34 and there is an external thread 36 on the second plug 32 to be received in the threaded recess 34. The plugs 26 and 32 are chamfered and the pen 22 and base 12 are correspondingly chamfered.

A cable 38, preferably of stainless steel, extends between the first and second plugs 26 and 32. As shown particularly in FIG. 1 the cable extends through a central opening 40 in each plug and a simple tubular member 42 is crimped on each end of the cable 38 in a known manner. Member 42 is crimped beneath the plugs 26 and 32, that is after the cable 38 has been placed through the openings 40, to ensure retention of the plugs 26 and 32 on the cable 38. If required the cable can be coated with a plastic 43.

As shown in the drawings the base 12 is attached by an adhesive on the underside 14. Such an adhesive can be provided by a plastic disc 44 having adhesive on each side protected by protective layers in known manner. Disc 44 also acts to hold cylinder 20 in place. Such an adhesive can provide extremely strong adherence of the base 12 to the surface 10. The drawings also show that the cylinder 20 has an opening 46 to receive a screw 48 that extends into the surface 10 to provide additional security in mounting.

Figures 2, 2A:
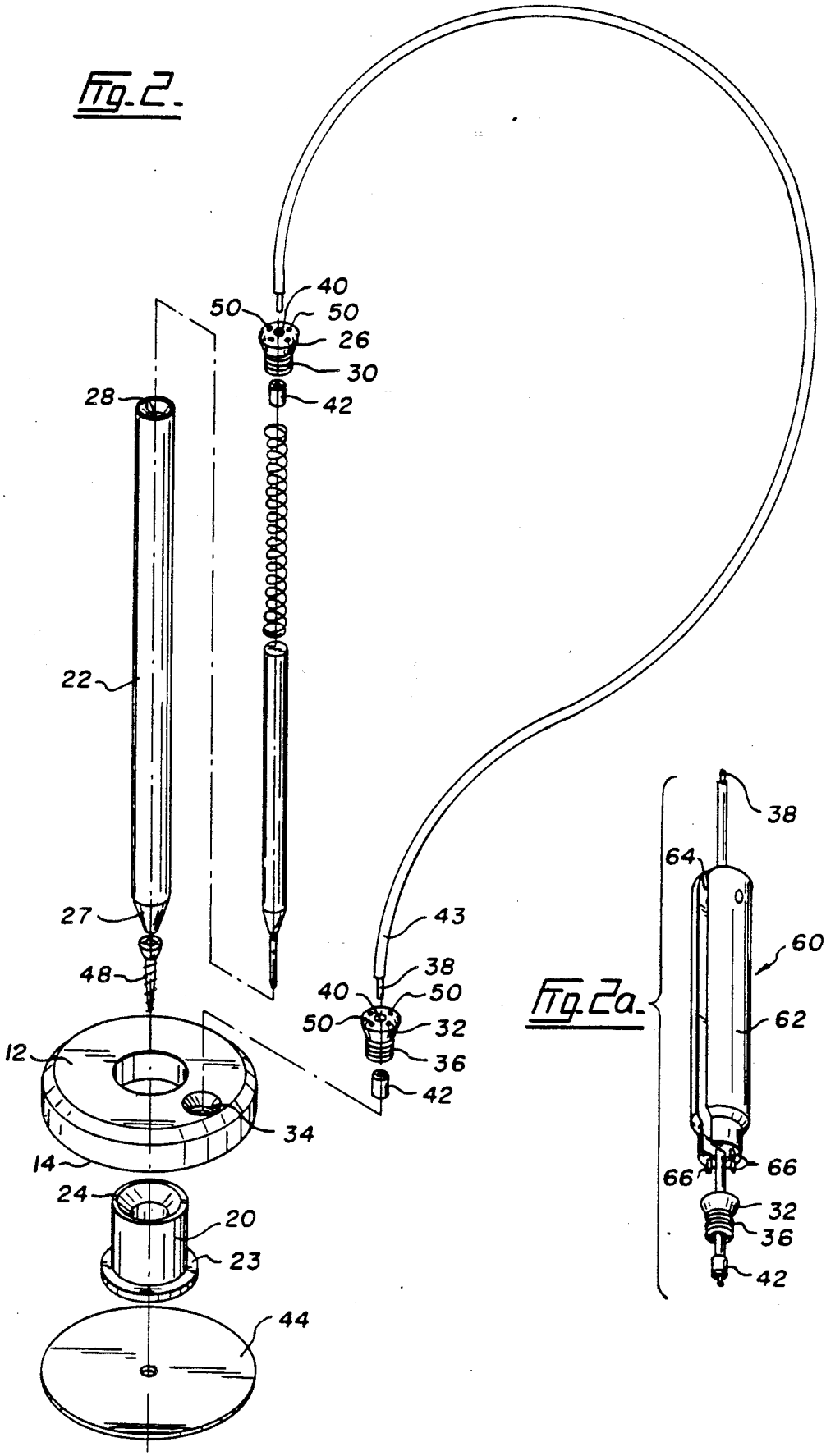
FIG. 2 is an exploded view of the holder of FIG. 1.
FIG. 2*a* is a perspective view of a tool alternative to the tool of FIG. 1*a* and also useful with the invention.

The holder of the present invention may be sold as a kit with the members 42 crimped on to each end of the cable 38 and, of course, the plugs 26 and 32 received on the cable 38. To install the kit the pen 22 may be constructed by inserting the conventional ink tube and spring within the barrel of the pen and then fastening the first plug 26 in the threaded end of the pen. It is desirable that the means of screwing the plug into position not be conventional. In particular it should not be such that a simple blade device, resembling a screwdriver, can be used to remove the plug 26. In the drawings, each plug is formed with spaced openings 50 and the kit will include a tool as shown in FIG. 1*a* or 2*a*. In FIG. 1*a* a tool 52 comprises a handle 54 having an opening 56 at one end to fit around the cable 38. On each side of the opening 56 are prongs 58 extending downwardly. The prongs 58 are dimensioned and spaced to engage the openings 50 in the plugs. Four openings 50 are shown in each plug in the drawings. Two are sufficient but the provision of four may facilitate use of the tool 52 when space is restricted.

In FIG. 2*a* a tool 60 comprises a generally cylindrical body 62 formed with a channel 64 dimensioned to be able to surround the cable 38 in the manner illustrated in FIG. 2*a*. At one end tool 60 is provided with three prongs 66 which will engage three of the openings 50 in a plug 26 or 32.

The mode of operation of tool 60 is precisely the same as that of tool 52 shown in FIG. 1*a* but tool 60 is easier to use on the lower plug 32 where the cylinder 20 may provide an obstruction to tool 52.

The second plug 32 is attached to the base 12.

Cylinder 20 is inserted upwardly through the base and the flange 23 engaged in the recess 18. One surface of the pad 44 is uncovered and the pad 44 is then adhered to the underside of the cylinder 20 and the base 12. The remaining surface of pad 44 is uncovered and then adhered to the surface 10. If required screw 48 is driven through the opening 46 in the cylinder 20, through a corresponding opening in the adhesive pad 44 and into the surface 10. The holder is then ready for use. The holder comprises a substantial number of components. Each is relatively cheap. Thus, if one component is broken, it is not necessary to replace the whole holder. The broken component alone may be replaced.

The stainless cable 38 means that cutting of the cable, which is known with prior art devices, is difficult.

In addition to the above essentially economic advantages, the holder of the present invention is pleasing in appearance. It may be made of aluminum to provide an extremely attractive holder for a pen. The barrel of the pen may be matched to the material used for the base and cylinder, contributing to the pleasing appearance of the holder.

The embodiments of the invention in which an exclusive property or privilege is claimed are defined as follows:

1. A writing implement holder to attach to a surface and comprising:

a base to be attached to the surface having an underside and including an opening;

a recess in the underside, surrounding the opening;

a cylinder to receive the writing implement located in the opening in the base;

a flange at one end of the cylinder to be received in the recess in the underside of the base;

the upper surface of the cylinder extending inwardly, downwardly and being of a depth to prevent the writing implement being used to lever the base from the surface;

a first plug to be received in the writing implement;

a second plug to be received in the base;

a cable extending between the first and second plug, with each end of the cable secured beneath a plug whereby the writing implement is attached to the base.

2. A holder as claimed in claim 1 in which the writing implement is a pen.

3. A holder as claimed in claim 1 in which the base is attached by an adhesive on the underside.

4. A holder as claimed in claim 1 having an opening in the cylinder to receive a screw that extends into the surface.

5. A holder as claimed in claim 1 in which the writing implement has an internal thread;

an external thread on the first plug to be received in the internal thread of the writing implement.

6. A holder as claimed in claim 1 in which the base has a threaded recess;

an external thread on the second plug to be received in the threaded recess.

7. A holder as claimed in claim 1 in which the plugs have means in their upper surfaces to allow screwing and unscrewing into the pen and the base respectively.

8. A holder as claimed in claim 7 in which the means comprise spaced opening formed in the upper surface of each plug.

9. A holder as claimed in claim 8 including a tool comprising a handle with prongs projecting downwardly, the prongs being dimensioned and spaced to engage the openings in the plug.

10. A holder as claimed in claim 1 in which the cable extends through a central opening in each plug;

a member crimped to each end of the cable, beneath the plug, to ensure retention of the plug on the cable.

11. A holder as claimed in claim 10 in which the cable is of stainless steel.

* * * * *

UNITED STATES PATENT AND TRADEMARK OFFICE

CERTIFICATE OF CORRECTION

PATENT NO. : 5,123,548

DATED : June 23, 1992

INVENTOR(S) : Alexander P. Milne

It is certified that error appears in the above-identified patent and that said Letters Patent is hereby corrected as shown below:

Item [57]

Abstract, line 16, change "uncoventional" to -- unconventional --.

Column 1, line 51, change "attach" to -- attached --.

Signed and Sealed this

Fourteenth Day of September, 1993

Bruce Lehman

*Attest:*

BRUCE LEHMAN

*Attesting Officer*

*Commissioner of Patents and Trademarks*